US006430794B1

(12) United States Patent
McKee

(10) Patent No.: US 6,430,794 B1
(45) Date of Patent: Aug. 13, 2002

(54) FEMALE CRIMPING DIE AND SYSTEM FOR CRIMPING METAL SHEETS

(76) Inventor: James E. McKee, 2942 Red Bird La., Grapevine, TX (US) 76051

( * ) Notice: Subject to any disclaimer, the term of this patent is extended or adjusted under 35 U.S.C. 154(b) by 0 days.

(21) Appl. No.: 09/572,633

(22) Filed: May 17, 2000

(51) Int. Cl.[7] ..... B23P 19/04
(52) U.S. Cl. ..... 29/243.5
(58) Field of Search ..... 29/243.529, 798, 29/509, 432, 522 A, 243.52, 243.53, 21.1, 243.5; 72/465.1, 466, 470, 471, 478, 395

(56) References Cited

U.S. PATENT DOCUMENTS

| | | | |
|---|---|---|---|
| 2,288,308 | A | 6/1942 | Williams |
| 2,619,855 | A | 12/1952 | Williams |
| 2,626,687 | A | 1/1953 | Williams |
| 2,671,361 | A | 3/1954 | Sandberg |
| 2,688,890 | A | 9/1954 | Williams |
| 2,924,312 | A | 2/1960 | Williams |
| 3,130,489 | A | 4/1964 | Schlage |
| 3,276,112 | A | 10/1966 | Tantlinger et al. |
| 3,579,809 | A | 5/1971 | Wolf et al. |
| 3,726,000 | A | 4/1973 | Hafner |
| 3,729,804 | A | 5/1973 | Middleton |
| 3,763,687 | A | 10/1973 | Numoto et al. |
| 3,828,421 | A | 8/1974 | Erlichman |
| 3,993,428 | A | 11/1976 | Gumm et al. |
| 4,130,922 | A | 12/1978 | Koett |
| 4,208,776 | A | 6/1980 | Schleicher |
| 4,306,511 | A | 12/1981 | Ashby et al. |
| 4,344,794 | A | 8/1982 | Szulczyk |
| 4,459,735 | A | 7/1984 | Sawdon |
| 4,584,753 | A | 4/1986 | Eckold et al. |
| 4,614,017 | A | 9/1986 | Eckold et al. |
| 4,615,353 | A | 10/1986 | McKee |
| 4,658,502 | A | 4/1987 | Eckold |
| 4,754,776 | A | 7/1988 | McKee |
| 4,757,609 | A | 7/1988 | Sawdon |
| 4,760,634 | A | 8/1988 | Rapp |
| 4,803,767 | A | 2/1989 | Obrecht et al. |
| 4,831,704 | A | 5/1989 | Rapp |
| 4,972,565 | A | 11/1990 | Eckold et al. |
| 5,072,518 | A | 12/1991 | Scott |
| 5,177,861 | A | 1/1993 | Sawdon |
| 5,626,071 | A | 5/1997 | Schneider et al. |
| 5,860,315 | A | 1/1999 | Sawdon |
| 5,992,206 | A | 11/1999 | Kuhne |

*Primary Examiner*—Robert C. Watson
(74) *Attorney, Agent, or Firm*—F. Lindsey Scott

(57) ABSTRACT

A system for crimping metal sheets and a female die designed for use in crimping metal sheets. According to the present invention, a female die for use by interaction with a male die to join metal sheets together by interaction of the dies to cut or slice through the sheets to form portions of the metal sheets which are spread by material flow by the interaction of the dies to prevent separation of the metal sheets is disclosed. The female die comprises an anvil member having a first and a second end and including an anvil surface at its first end, and a base at its second end; at least two side plates positioned on the anvil member to restrict movement of the side plates toward the second end during interaction of the dies, the side plates being resiliently biased toward the anvil surface to permit movement of the side plates away from the anvil surface during the spreading of the portions of the metal sheets, and extending a selected distance beyond the anvil surface in a direction away from the base; and, at least one spring member supported by the base and in biasing engagement with each of the side plates to resiliently bias the side plates toward the anvil surface.

18 Claims, 5 Drawing Sheets

FEMALE CRIMPING DIE AND SYSTEM FOR CRIMPING METAL SHEETS

FIELD OF THE INVENTION

This invention relates to a system for crimping metal sheets and more particularly to a female die designed for use in crimping metal sheets.

BACKGROUND OF THE INVENTION

It is well known that metal sheets can be joined by devices for joining the metal sheets by a riveting type method utilizing mating dies in which the counter edges provided by the female die are yieldable. Such devices have been shown in U.S. Pat. No. 4,614,017, "Device For Joining Metal Sheets By A Riveting-Type Method", issued Sep. 30, 1986, to Gerd—Gürgen Eckold and Hans Maass. This patent discloses in general that female dies having edges, which are yieldable, can be used with a male die to form joints. These joints are generally formed by cutting the metal sheets by interaction of the male die and the edges of the female die with the edges of the female die then yielding outwardly so that by further interaction of the dies, a portion of the cut material is spread by material flow to form a strong joint in the vicinity of the cuts and the material flow. Such techniques are referred to generally as "crimping". Crimping is widely used to join thin metal sheets of a variety of types for a variety of applications. Considerable effort has been directed to the development of effective and economical tools for use for this purpose.

Unfortunately, the fabrication of the female dies is relatively expensive and many of the dies currently in use are not readily repairable, nor are they readily adjusted to accommodate various thicknesses of metal sheets and the like. Accordingly, a continuing effort has been directed to the development of a better system for joining metal sheets by crimping, and in particular, a considerable effort has been directed to the development of an improved female die.

SUMMARY OF THE INVENTION

According to the present invention, a female die for use by interaction with a male die to join metal sheets together by interaction of the dies to cut or slice through the sheets to form portions of the metal sheets which are spread by material flow by the interaction of the dies to prevent separation of the metal sheets is disclosed. The female die comprises an anvil member having a first and a second end and including an anvil surface at its first end, and a base at its second end; at least two side plates positioned on the anvil member to restrict movement of the side plates toward the second end during interaction of the dies, the side plates being resiliently biased toward the anvil surface to permit movement of the side plates away from the anvil surface during the spreading of the portions of the metal sheets, and extending a selected distance beyond the anvil surface in a direction away from the base; and, at least one spring member supported by the base and in biasing engagement with each of the side plates to resiliently bias the side plates toward the anvil surface.

The present invention further includes a system for joining metal sheets together by interaction of a male die and a female die to cut or slice through the sheets to form portions of the metal sheets which are spread by material flow by the interaction of the dies to prevent separation of the metal sheets, the system comprising:

a) a female die including an anvil member having a first and a second end and including an anvil surface at its first end, and a base at its second end; at least two side plates secured to the anvil member to restrict movement of the side plate toward the second end during interaction of the dies, the side plates being resiliently biased toward the anvil surface to permit movement of the side plates away from the anvil surface during the spreading of portions of the metal sheets, and extending a selected distance beyond the anvil surface in a direction away from the base; and, at least one spring member supported by the base and in biasing engagement with each of the side plates to resiliently bias the side plates toward the anvil surface;

b) a male die comprising a punch having cutting edges and configured to interact with the side plates of the female die to cut the metal sheets to form portions of the metal sheets which are spread between the punch and the anvil surface; and, c) a device for moving the male die toward the female die at sufficient pressure and velocity for interaction with the female die to cut or slice through the metal sheets to form portions of the metal sheets which are spread by material flow by the interaction of the dies.

DESCRIPTION OF PREFERRED EMBODIMENTS

In the discussion of the Figures, the same numbers will be used throughout to refer to the same or similar components.

Figure 1:
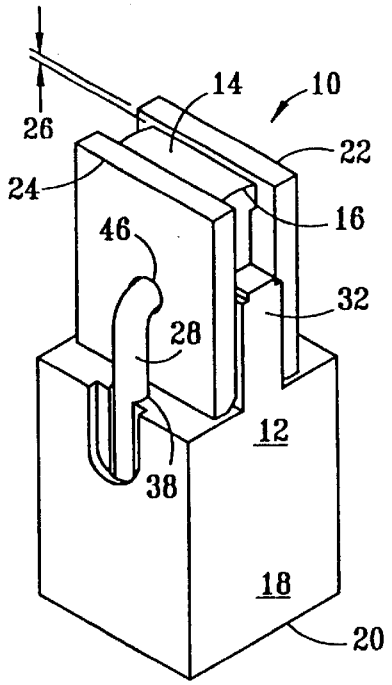
FIG. 1 is an isometric view of an embodiment of a female die according to the present invention.
Figure 2:
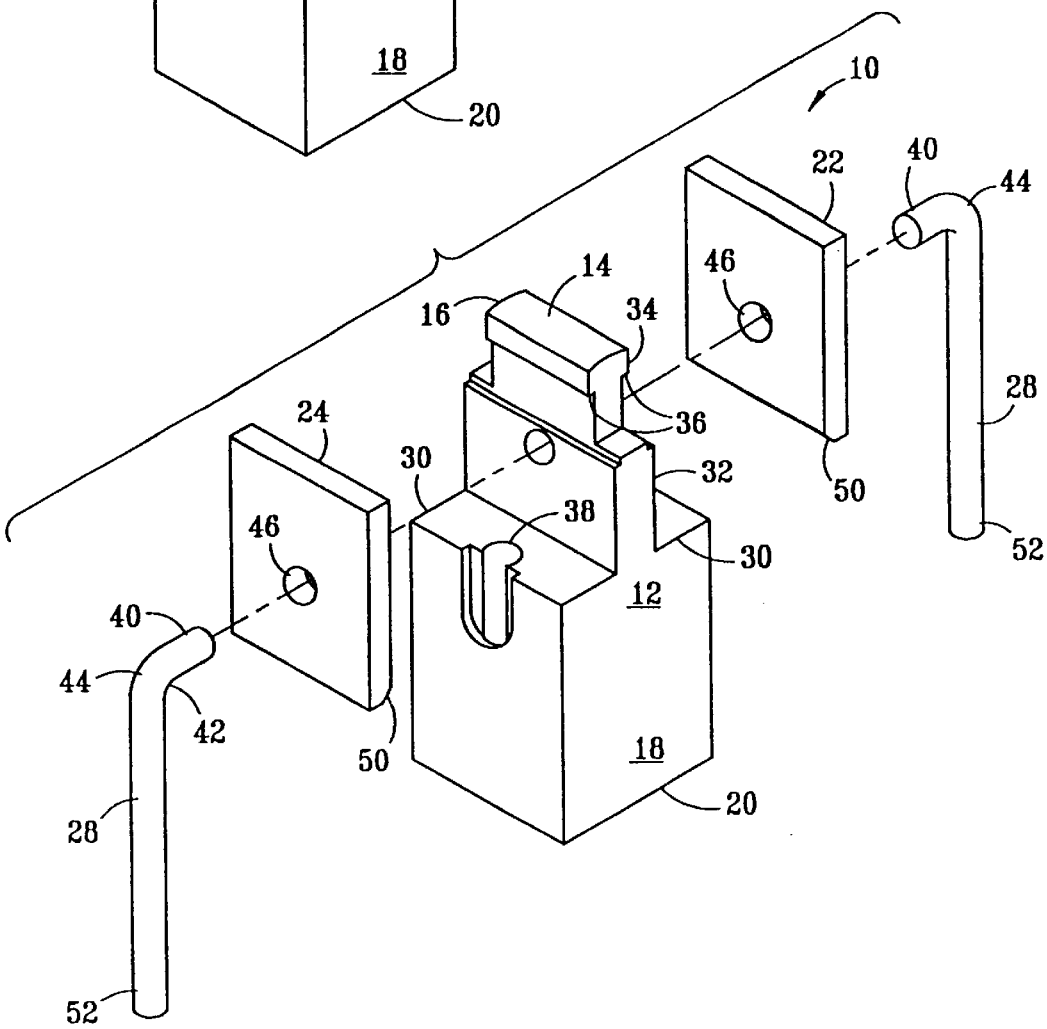
FIG. 2 is an exploded view of the female die of FIG. 1.

In FIGS. 1 and 2, a female die 10 is shown. Die 10 comprises an anvil member 12, which includes an anvil surface 14 at its first end 16 and a base 18 at its second end 20. Side plates 22 and 24 are positioned against the sides of anvil surface 14. Anvil surface 14 is supported by an anvil support 32, which has at its upper end an enlarged portion 34 with the anvil support member being slightly smaller beneath enlarged portion 34. An inset 36 is shown at the bottom of enlarged portion 34 in FIG. 2. This reduced section is desirable to permit fine metal particles to move downwardly and out of die 10 without holding side plates 22 and 24 away from anvil surface 14. Anvil member 12 includes a shoulder 30, which, as shown, supports side plates 22 and 24 in position. Receptacles 38 are positioned in base 18 to receive spring members 28 which are configured to have a protrusion 40 on their upper ends 44. Spring members 28 as shown are spring wire. Any suitable spring wire may be used. Some suitable spring wires are coiled spring wires for tension or compression springs and the like, of a size suitable to maintain the desired force against the side plates. The wire is bent at a radius 42 from about 1.0 to about 2.0 wire diameters to form the protrusion 40. Protrusion 40 is positioned in an opening 46 in each of side plates 22 and 24. The spring wire is positioned in base 18 to impose a slight tension on side plates 22 and 24 toward anvil surface 14. While desirable, it is not necessary that the springs maintain a biasing force toward anvil 14 at rest so long as the springs are positioned to maintain the side plates against the anvil surface. As indicated, it is desirable that there be a slight biasing toward anvil surface 14 at all times. As shown, side plates 22 and 24 include a beveled surface 50, which facilitates positioning side plates 22 and 24 on shoulder 30 which may also include a bevel surface at the junction of anvil support members 32 and shoulder 30.

In the operation of the female die to crimp metal sheets and form connections there between, a male die is passed downwardly into engagement with a pair of metal sheets positioned over the female die. The male die may comprise a rectangular surface and may include cutting edges configured to interact with the side plates of the female die The male die is moved toward anvil surface 14 with sufficient force to cut the metal sheets at the edges of side plates 22 and 24. This cut material between side plates 22 and 24 is engaged by further interaction of the male die and the female die so that the material is spread by material flow to form a strong joint between the two sheets. As the material flow occurs, side plates 22 and 24 are forced apart to facilitate the material flow. When the joint is complete and removed from the female die, it is important that side plates 22 and 24 be urged back into contact with anvil surface 14.

The die shown in Figures and 1 and 2 is readily assembled by positioning the side plates against the sides of anvil 14 with the spring members engaged. The second ends 52 of the spring members are then directed into receptacles 38 which are shown as drilled holes in base 18. The side plates are then pushed downwardly to move the springs into receptacles 38 in base 18. Receptacles 38 are oriented to result in the thus positioned spring members maintaining plates 22 and 24 in contact with the sides of anvil 14. Side plates 22 and 24 may be made of any suitably hard material, which will be effective to shear the metal sheets. For instance, any suitable oil-hardened or air-hardened die steel may be used for this purpose. Similarly, commonly available spring wire may be used as string members 28. It is not necessary that spring members 28 be formed of wire. Alternatively, these wires could be formed of a suitable spring metal in any desired shape. It is believed that the use of spring wire will be more economical and is preferred since it is easier to position round holes in base 18 than receptacles of other shapes. Notwithstanding this consideration, other configurations of springs could be used provided the springs have a suitable protrusion on their upper ends for engaging side plates 22 and 24 and so long as the lower portion of the springs are configured for support in base 18 to provide the desired biasing of side plates 22 and 24 toward anvil surface 14.

It is desirable that the top of side plates 22 and 24 be at a selected distance 26 above anvil surface 14. Desirably, this distance is selected to represent about 50 to about 60 percent of the thickness of the two metal layers. This distance is shown by the dimension 26 in FIG. 1.

Figure 3:
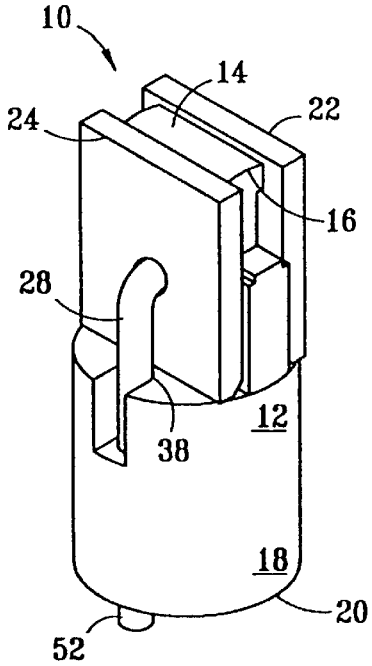
FIG. 3 is an isometric view of a further embodiment of the female die according to the present invention.

In FIG. 3, a further embodiment of the present invention is shown. This embodiment is similar to the embodiment as shown in FIGS. 1 and 2 except that a round base is used. Further, second ends 52 of springs 28 extend beyond second end 20 of anvil member 12. This wire may be used as a positioning member and the like. Of course, when spring end 52 of one of these spring members extends beneath base 18 it is convenient to extend the second end of the other spring member below the second end anvil member 12 also.

The use of either a square or a round base or a base of any other convenient shape is considered to be within the scope of the present invention. The base may include on second end of 20 of the base any suitable male, female or pinning arrangement to position female die 10 in position. Such variations are considered to be well known to those skilled in the art. In general, the use of female dies and crimping techniques are considered to be well known to those skilled in the art, however, the female die of the present invention is considered to afford unique advantages to those skilled in the art as discussed hereinafter.

Figure 4:
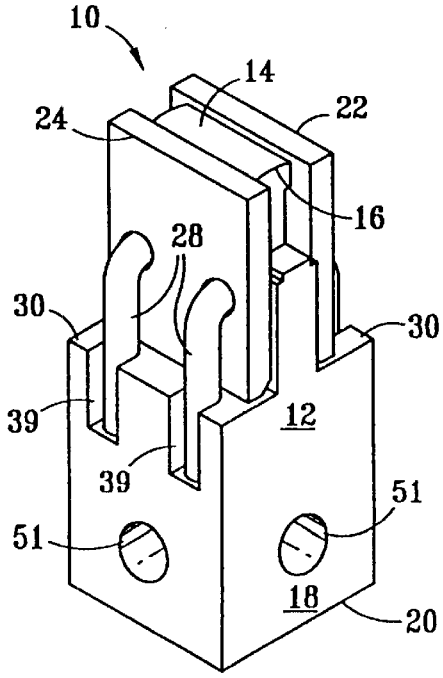
FIG. 4 is a further embodiment of a female die according to the present invention.
Figure 5:
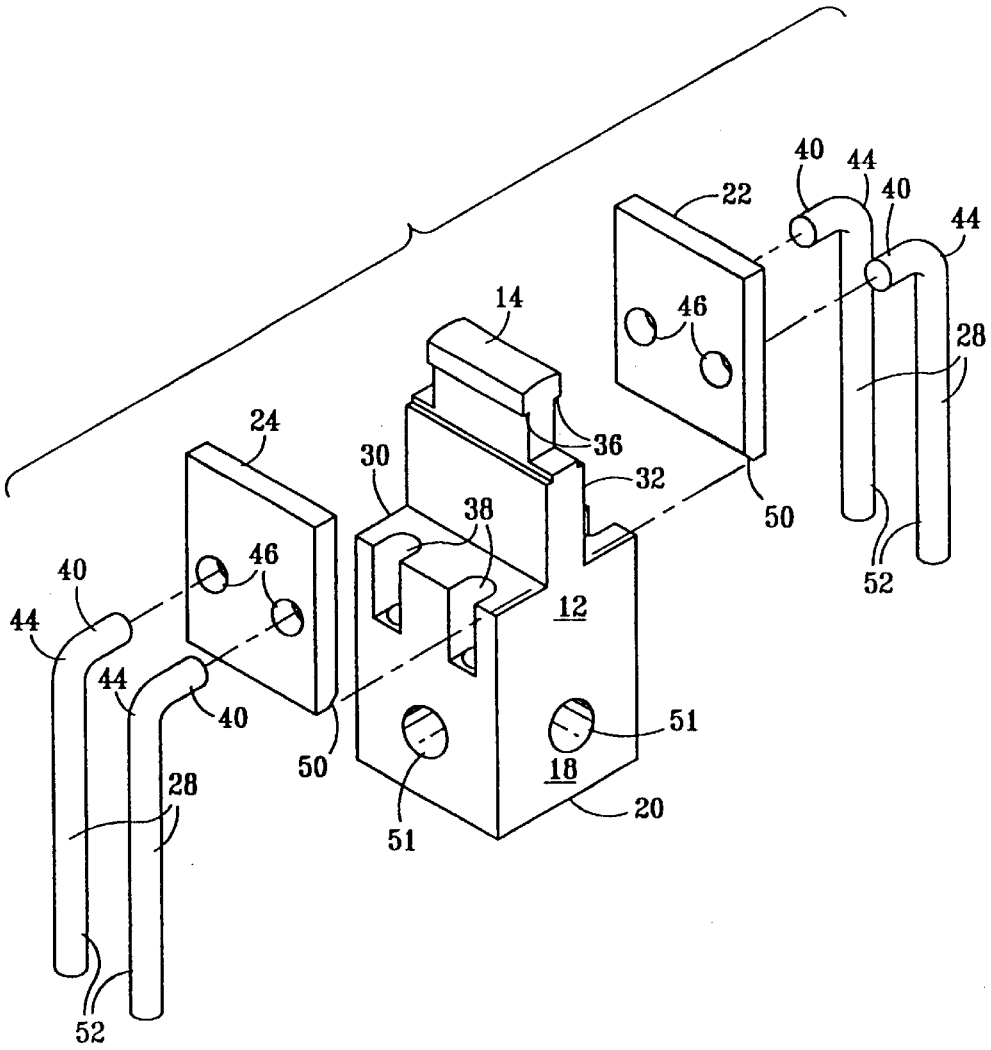
FIG. 5 is an exploded view of the female die shown in FIG. 4.

In FIGS. 4 and 5, alternate embodiments of the present invention are shown. In these embodiments, two spring members are used with each of side plates 22 and 24.

In other respects, the embodiment shown in FIG. 4 is similar to the embodiment shown in FIGS. 1 and 2. Certain variations, however, have been shown in the embodiments shown in FIG. 4. In particular, openings 51 are shown in base 18 for positioning female die 10 by use of a pin or rod arrangement by use of bolts, screws or the like. Further it should be noted that spring members 28 are positioned in receptacles 38 in base 18 which have been opened on their sides by recesses 39 to permit spring members 28 to deform. This arrangement, while effective, could be substituted by an arrangement which positions a second shoulder, not shown, at the bottom of the recesses shown in FIGS. 4 and 5. Such variations are considered to be well known to those skilled in the art.

Figure 6:
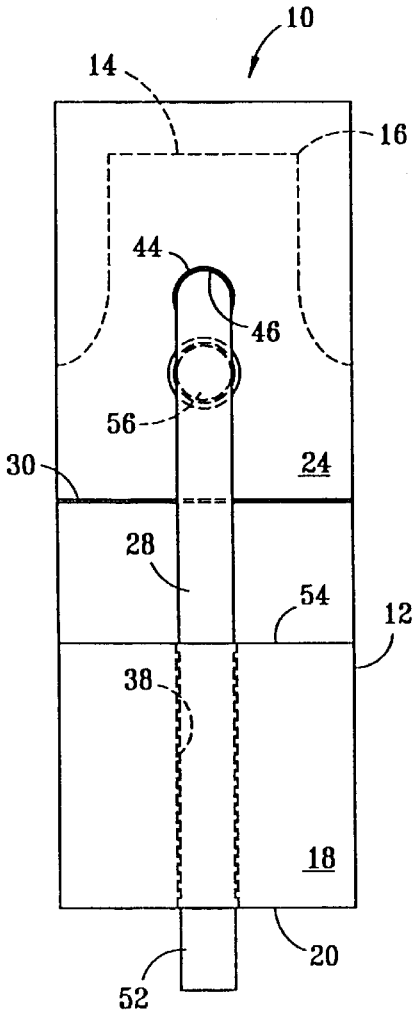
FIG. 6 is a side view of a female -die according to the present invention.

In FIG. 6, a side view of a female die according to the present invention is shown. Side plate 24 is held in position by spring member 28 which is positioned with a protrusion on first end 44 of spring member 28 extending into and in engagement with an opening 46 in plate 24. A second shoulder 54 is shown and as a result, no open slots at the side of receptacles 38 have been shown. Receptacles 38 are shown through base 18 by a dotted line. It will be noted by reference to FIG. 6, that anvil surface 14 is of a lesser length than side plates 22 and 24. This is desirable since the cuts in the metal sheets are no greater than the length of the tops of side plates 22 and 24. The deformation of these sheets will be restrained to some extent by the ability of the cut portions of the sheets to bend downwardly to anvil surface 14 where the material flow is accomplished. Accordingly, it is unnecessary for anvil surface 14 to be as wide as the tops of side plates 22 and 24.

Figure 7:
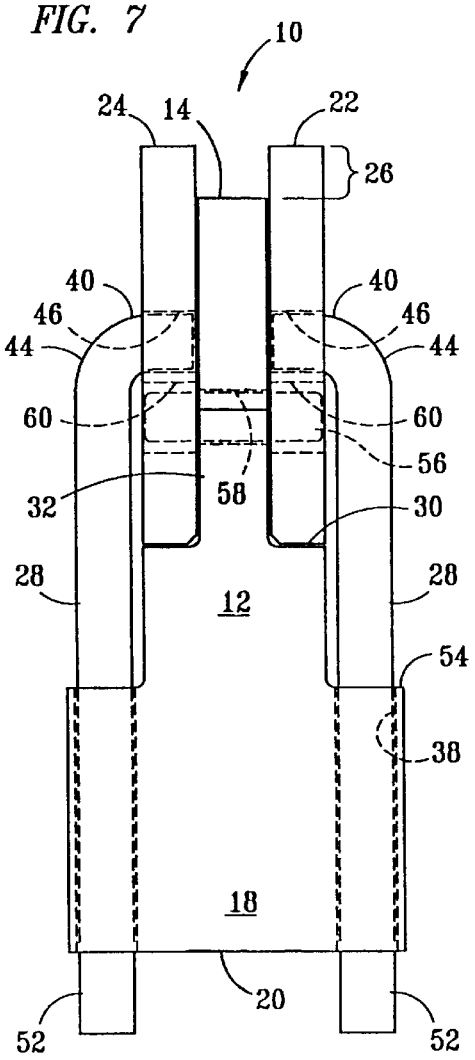
FIG. 7 is an end view of the female die shown in FIG. 6.

In FIG. 7, a side view of the female die shown in FIG. 6 is shown. The distance of the tops of side plates 22 and 24 above anvil surface 14 is shown by the numeral 26. As discussed previously, this distance is typically about 50 to about 70 percent of the combined thickness of the metal sheets. As shown, protrusions 46 on spring members 28 basically engage openings 46 in side plates 22 and 24 and are positioned to urge plates 22 and 24 toward anvil surface 14.

Figure 8:
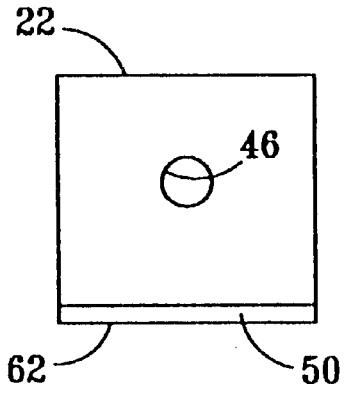
FIG. 8 shows an embodiment of a side plate.
Figure 9:
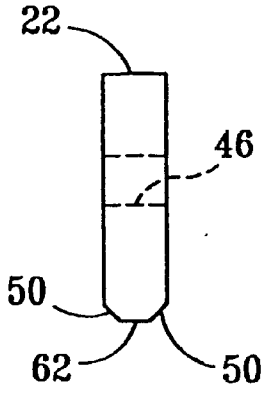
FIG. 9 is an end view of the side plate of FIG. 8.

In FIG. 8, a view of side plate 22 is shown including an opening 46 to receive a protrusion on the end of a spring member. Side plate 22 includes a bevel 50 at its lower edge 62. As shown in FIG. 9, bevels can be placed on each side of side plate 22 so that side plate 22 if desired can be reversed.

Figure 10:
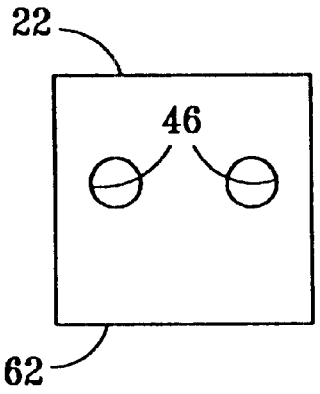
FIG. 10 shows an alternate embodiment of a side plate.
Figure 11:
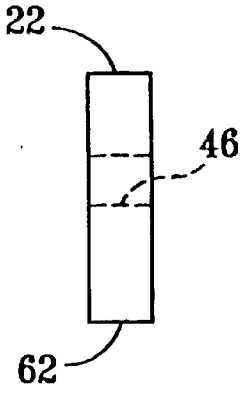
FIG. 11 is an end view of the side plate shown in FIG. 10.

In FIG. 10, a side plate 22 is shown having two spring openings. Side plate 22 in FIG. 10 does not include a bevel on its bottom 62. In FIG. 11, an end view of side plate 22 is shown. It will be understood that side plate 22 could be manufactured with only one bevel or with no bevels if the seating arrangement on shoulder 30 is such that no bevel is required.

In the operation of the die of the present invention, the metal pieces are placed over the female die and then engaged by a male die which presses downwardly to interact with the female die to shear the two metals pieces at the edges of the side plates. The male die is then further urged toward anvil member 14 under sufficient pressure or impact conditions to result in a material flow of the metal sheets to form a joint, which is not readily separated. The joint is then removed from the female die and side plates 22 and 24 are returned by the spring members to their former position. The anvil surface includes a recessed area beneath an enlarged portion which forms anvil surface 14 so that small metal flakes and the like can fall between side plates 22 and 24 and anvil support member 32 and ultimately out of die 10. It is well known in the art that it may be desirable in some instances to simply blow fine metal particles from the die with an air hose or the like to prevent their interference with operation of the die. The dies of the present invention can be positioned for use in a clamp-like device for bringing a male die into interaction with a female die in a press or other suitable device for moving a male die into interactive engagement with the female die. This interaction may be achieved by pressure, by impact or any combination thereof. Typically, a device is provided which is capable of moving the male die toward the female die at sufficient pressure and velocity for interaction with the female die to cut or slice through the metal sheets to form portions of the metal sheets which are spread by material flow. The device may be a press, which may be air or hydraulically activated, or it may be a hand gun which functions basically as a clamp to bring the dies and metal pieces into proper engagement and thereafter bring the dies and metal piece sheets into proper position and thereafter achieves interaction of the dies to form the crimped joint and the like.

As previously noted, the side plates may be formed of any suitable oil-hardened or air-hardened die steel. Typically the spring members are wire which may be of any suitable size but is typically about 0.093 to about 0.125 inches in diameter and of any suitable tempered compression spring or coiled spring stock. The spring members could be formed of a flat wire or other configurations if desired.

It should be noted that particularly with the embodiment utilizing a single wire to maintain the desired biasing pressure on side plates, that the side plate may be rotatable so that all four sides may be usable as cutting edges, if no bevel is used, until they become damaged or otherwise unusable. If a bevel is used the unbeveled sides may be used as cutting edges. This provides for use of multiple sides of each side piece. Further, the side pieces can be reversed to provide fresh cutting edges. When two springs are used with each side plate, the side plates can be reversed so that each side of the top of the side plates can be used as a cutting edge, and if no bevels are used, the bottoms of the side plates can be similarly used as cutting edges. By the use of a second set of holes, all four sides can be used.

In the event that one or more of the spring members becomes damaged, these are readily replaced. The entire die is readily disassembled by simply placing it in a suitable vice or press and pushing the spring members out of receptacles 38 in base 18. This permits the replacement of any or all of the spring members and the repositioning or replacement of either of the side plates. This also permits the replacement of the side plates for a particular task with other side plates. In particular, if different thicknesses of metal sheets are to be crimped, it may be desirable to change the distance 26 between the top of side plates 22 and 24 and anvil surface 14. This is readily accomplished as discussed. With most existing dies, the die must be replaced when the cutting edges have been worn out or broken or when different thickness metal sheets are crimped.

Also please note in FIGS. 6 and 7, that a pin 56 may be positioned through anvil support member 32 to maintain side plates 22 and 24 in position relative to anvil support member 32. Pin 56 is positioned in anvil support member 32 in an opening 58 and extends into an opening 60 in side plates 22 and 24. The use of this pin is optional. It results in maintaining side plates 22 and 24 more precisely in position, but has been found to be unnecessary for most applications.

Accordingly, the die of the present invention is economical to assemble initially, economical and easy to disassemble and repair, and permits the flexibility to use the same die for different thicknesses of metal sheets. These are important advantages, and when coupled with the durability and easy repairability of the die, represent a substantial improvement in the construction of female dies for use in crimping. The present invention further comprises a system for crimping using the female die of the present invention with a suitable male die and a device for moving the male die toward the female die at a sufficient pressure and velocity for interaction with the female die.

Having thus described the invention with respect to certain of its preferred embodiments, it is pointed out that the embodiments described are illustrative rather than limiting and that many variations and modifications are possible within the scope of the present invention. Many such variations and modifications may be considered obvious and desirable by those skilled in the art based upon a review of the foregoing description of preferred embodiments.

Having described the invention, I claim:

1. A female die for use by interaction with a male die to join metal sheets together by interaction of the dies to cut or slice through the sheets to form portions of the metal sheets which are spread by material flow by the interaction of the dies to prevent separation of the metal sheets, the female die comprising:

a) an anvil member having a first and a second end, an anvil surface at its first end, a base at its second end and at least one shoulder positioned between the anvil surface and the base;

b) at least two side plates positioned on the anvil member, each of said side plates being supported by one of the at least one shoulders and retained in position by the one shoulder relative to the base during interaction of the dies, the side plates being resiliently biased toward the anvil member to permit movement of the side plates away from the anvil member during the spreading of portions of the metal sheets, and extending a selected distance beyond the anvil surface in a direction away from the base at least one of the male die and the side plates including cutting edges adapted to cut or slice through the sheets by interaction of the male die and the side plates; and, c) at least one spring wire member supported by the base and in biasing engagement with each of the side plates to resiliently bias the side plates toward the anvil member.

2. The die of claim 1 wherein the anvil surface is a rectangular surface having a first side and a second side and a first end and a second end.

3. The die of claim 2 wherein a side plate is positioned on each side of the anvil surface and supported on a shoulder.

4. The die of claim 3 wherein the at least one spring wire member comprise elongated spring having a first end, each of the at least one spring wire members being positioned in a receptacle in the base to extend from the base toward the first end of the anvil member so that the first end of the spring member biasingly engages a side plate.

5. The die of claim 4 wherein the at least one spring wire member includes on the first end a protrusion, which is positioned to engage a receptacle opening in a side plate.

6. The die of claim 4 wherein two spring wire members are positioned to bias each side plate toward the anvil member.

7. The die of claim 5 wherein a protrusion is formed on the first end of the spring wire member by bending an end portion of the spring wire on a radius from about 0.5 to about 1.5 wire diameters.

8. The die of claim 7 wherein the protrusion is positioned in a receptacle opening in a side plate which is biased toward the anvil member by the spring wire bearing the protrusion.

9. The die of claim 1 wherein the base includes a male or female fastener to position the die in an apparatus for use with a male die to join metal sheets.

10. The die of claim 1 wherein the spring wire members comprise elongated spring wires having a first end, the spring members being positioned in receptacles in the base to extend from the base toward the first end of the anvil member so that the first ends of the spring wires biasingly engage the side plates.

11. The die of claim 2 wherein two spring members are positioned to bias each side plate toward the anvil member.

12. The die of claim 11 wherein at least one spring member is a spring wire.

13. The die of claim 12 wherein a protrusion is formed on a first end of the spring member by bending an end portion of the wire on a radius from about 0.5 to about 1.5 wire diameters.

14. The die of claim 13 wherein the protrusion is positioned in a receptacle opening in a side plate which is biased toward the anvil member by the spring bearing the protrusion.

15. A system for joining metal sheets by use of a female die and a male die to join metal sheets together by interaction of the dies to cut or slice through the sheets to form portions of the metal sheets which are spread by material flow by the interaction of the dies to prevent separation of the metal sheets, the system comprising:

a) a female die including an anvil member having a first and a second end an anvil surface at its first end, a base at its second end and at least one shoulder positioned between the anvil surface and the base; at least two side plates positioned on the anvil member each of said side plates being supported by one of the at least one shoulder and retained in position by the one shoulder relative to the base during interaction of the dies, the side plates being resiliently biased toward the anvil member to permit movement of the side plates away from the anvil member during the spreading of portions of the metal sheets, and extending a selected distance beyond the anvil surface in a direction away from the base and at least one spring member supported by the base and in biasing engagement with each of the side plates to resiliently bias the side plates toward the anvil member;

b) a male die comprising a punch having cutting edges and configured to interact with the side plates of the female die to cut the metal sheets to form portions of the metal sheets material which are deformed between the punch and the anvil; and c) a device for moving the male die toward the female die at sufficient pressure and velocity for interaction with the female die to cut or slice through the metal sheets to form portions of the metal sheets which are spread by material flow by the interaction of the dies.

16. The system of claim 15 wherein the device is a press.

17. The system of claim 16 wherein the device is air activated.

18. The system of claim 16 wherein the device is hydraulically powered.

* * * * *